US008699737B2

(12) United States Patent
Mamin

(10) Patent No.: US 8,699,737 B2
(45) Date of Patent: Apr. 15, 2014

(54) COOLING SYSTEM FOR LOUDSPEAKER TRANSDUCERS

(75) Inventor: Jean-Pierre Mamin, La Tour-de-Peliz (CH)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 1385 days.

(21) Appl. No.: 11/800,094

(22) Filed: May 4, 2007

(65) Prior Publication Data

US 2007/0258612 A1 Nov. 8, 2007

Related U.S. Application Data

(60) Provisional application No. 60/797,944, filed on May 5, 2006.

(51) Int. Cl.
*H04R 1/20* (2006.01)

(52) U.S. Cl.
USPC ..... 381/338; 381/337

(58) Field of Classification Search
USPC ..... 381/384, 345, 165, 189, 338, 337; 181/156, 141; 174/17; 348/748
See application file for complete search history.

(56) References Cited

U.S. PATENT DOCUMENTS

| | | | | |
|---|---|---|---|---|
| 1,683,946 | A * | 9/1928 | Baldwin | 381/162 |
| 3,991,286 | A * | 11/1976 | Henricksen | 381/189 |
| 4,757,547 | A | 7/1988 | Danley | |
| 4,811,403 | A * | 3/1989 | Henricksen et al. | 381/87 |
| 5,140,641 | A * | 8/1992 | Danley et al. | 381/339 |
| 5,357,586 | A | 10/1994 | Nordschow et al. | |
| 5,792,999 | A * | 8/1998 | Arnold et al. | 181/141 |
| 6,345,685 | B1 * | 2/2002 | Wells et al. | 181/153 |
| 6,678,387 | B2 * | 1/2004 | Kemmerer | 381/397 |
| 6,723,913 | B1 * | 4/2004 | Barbetta | 174/17 VA |
| 7,677,354 | B2 * | 3/2010 | Osada et al. | 181/156 |
| 2006/0066761 | A1 * | 3/2006 | Tajima et al. | 348/748 |
| 2007/0008496 | A1 * | 1/2007 | Seki | 353/60 |

* cited by examiner

*Primary Examiner* — Duc Nguyen
*Assistant Examiner* — Phan Le
(74) *Attorney, Agent, or Firm* — Beeson Skinner Beverly, LLP

(57) ABSTRACT

A loudspeaker having a vented enclosure with at least one tuning port includes a fan inside the vented enclosure, which is positioned to produce airflow for cooling the magnetic assembly of the loudspeaker's transducer. Airflow within said vented enclosure is produced such that air within the enclosure is exchanged with outside air through the at least one tuning port. Typically, the vented enclosure will have two tuning ports wherein outside air drawn into the enclosure through one of the tuning ports is circulated out through the other tuning port. Preferably, the outside air drawn in through one tuning port is circulated directly around the transducer magnetic assembly for greatest heat dissipation.

5 Claims, 4 Drawing Sheets

COOLING SYSTEM FOR LOUDSPEAKER TRANSDUCERS

CROSS-REFERENCE TO RELATED APPLICATIONS

This application claims the benefit of U.S. provisional patent application Ser. No. 60/797,944, filed May 5, 2006, the entire contents of which are incorporated herein by reference.

FIELD OF THE INVENTION

The present invention relates to sound-producing transducers mounted in vented loudspeaker enclosures. In particular, it relates to the removal of the heat generated by transducers, particularly when operated at high acoustic power levels.

BACKGROUND

In modern applications, the power delivered to the transducers can be high, thus generating a significant amount of heat in the moving voice coil. This heat has various negative effects, one of which is the possible destruction of the moving coil wire insulation, resulting in an electrical short-circuit and ultimate failure of the device. As the insulation of a voice-coil wire is subjected to temperatures higher than its temperature rating, the life of the insulation will be reduced accordingly. This situation can cause the insulation to be damaged to the point of creating a short-circuit failure. By maintaining the temperature on the voice-coil below its rated temperature, the risk of burning the insulation prematurely is eliminated or greatly reduced.

Another negative aspect of heat generation is the deterioration of the magnetic characteristics of the permanent magnets used in the loudspeaker transducers. As a permanent magnet is subjected to temperatures higher than its temperature rating, its ability to maintain its magnetic characteristics is reduced accordingly. In a magnetic circuit, this loss of magnetic characteristics due to high temperatures has a direct reductive effect on the magnetic flux. In a transducer, the reduction of the magnetic flux will cause a loss in transducer efficiency. By maintaining the temperature of the magnet below its rated temperature, the loss of overall efficiency of the transducer due to overheating is eliminated.

To overcome the problems associated with overheated transducers, some manufacturers have attached a heat dissipating radiator on and/or around the magnetic assembly in order to improve the extraction and dissipation of the heat generated in the voice-coil. In these implementations, there is still a problem with heated air stagnating inside the enclosure, which greatly reduces the effect and benefit of this heat dissipating approach.

One heat dissipating technique is described in U.S. Pat. No. 4,757,547 to Thomas J. Danley. Danley discloses use of a blower connected by conduits directly to holes in the base plate of the magnetic assembly below the voice-coil gap to suck air out of the voice coil gap. In Danley, there is no provision for exchanging the heated air inside the enclosure with cooler outside air.

Therefore, need exists for an efficient cooling system in high-powered loudspeakers, and particularly in loudspeakers using vented enclosures where the heated air inside the enclosure can be exchanged with cooler outside air.

SUMMARY OF THE INVENTION

The present invention involves a loudspeaker having a vented enclosure with at least one, and typically two, tuning ports, which are vented to the outside of the loudspeaker, a transducer with a magnetic assembly that projects into the vented enclosure, and means for producing airflow within said vented enclosure such that air within the enclosure is exchanged with outside air through the at least one tuning port. Air circulation in the vented enclosure is most suitably provided by a fan positioned in the enclosure such that, when the fan is activated, outside air is drawn in through the at least one tuning port and circulated around the transducer's magnetic assembly to carry heat away from the assembly and the voice-coil contained within the assembly.

It is thus a primary object of the present invention to reduce the overall temperature of the transducer, and more specifically of the voice-coil wire and magnet of a transducer, in a vented loudspeaker enclosure. In accordance with the invention, cooling of the transducer is achieved by forcing the exchange of warmer air inside the loudspeaker enclosure with cooler outside air and preferably at the same time circulating the cooler air around the magnetic assembly of the transducer.

DETAILED DESCRIPTION OF THE ILLUSTRATED EMBODIMENT

Figure 3:
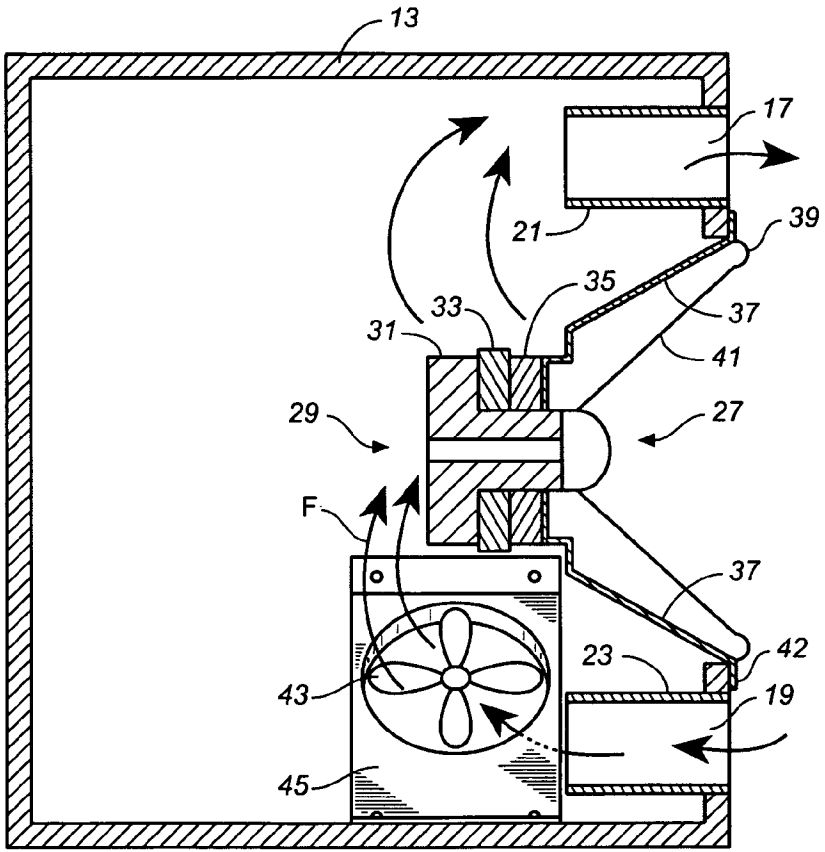
FIG. 3 is a cross-sectional view thereof taken along lines 3-3 of FIGS. 1 and 2.

Referring now to the drawings, and particularly to FIGS. 1-4, a loudspeaker 11 is seen to be comprised of a vented enclosure 13 having a front mounting wall 15 and a transducer 17 mounted to this front wall. Venting in the illustrated enclosure is accomplished by means of two front wall tuning ports 17, 19. As best seen in FIG. 3, these tuning ports include two upper and lower port cylinders 21, 23, which project into the enclosure's interior volume 25, and which allow for airflow into and out of the interior of the enclosure.

Figure 4:
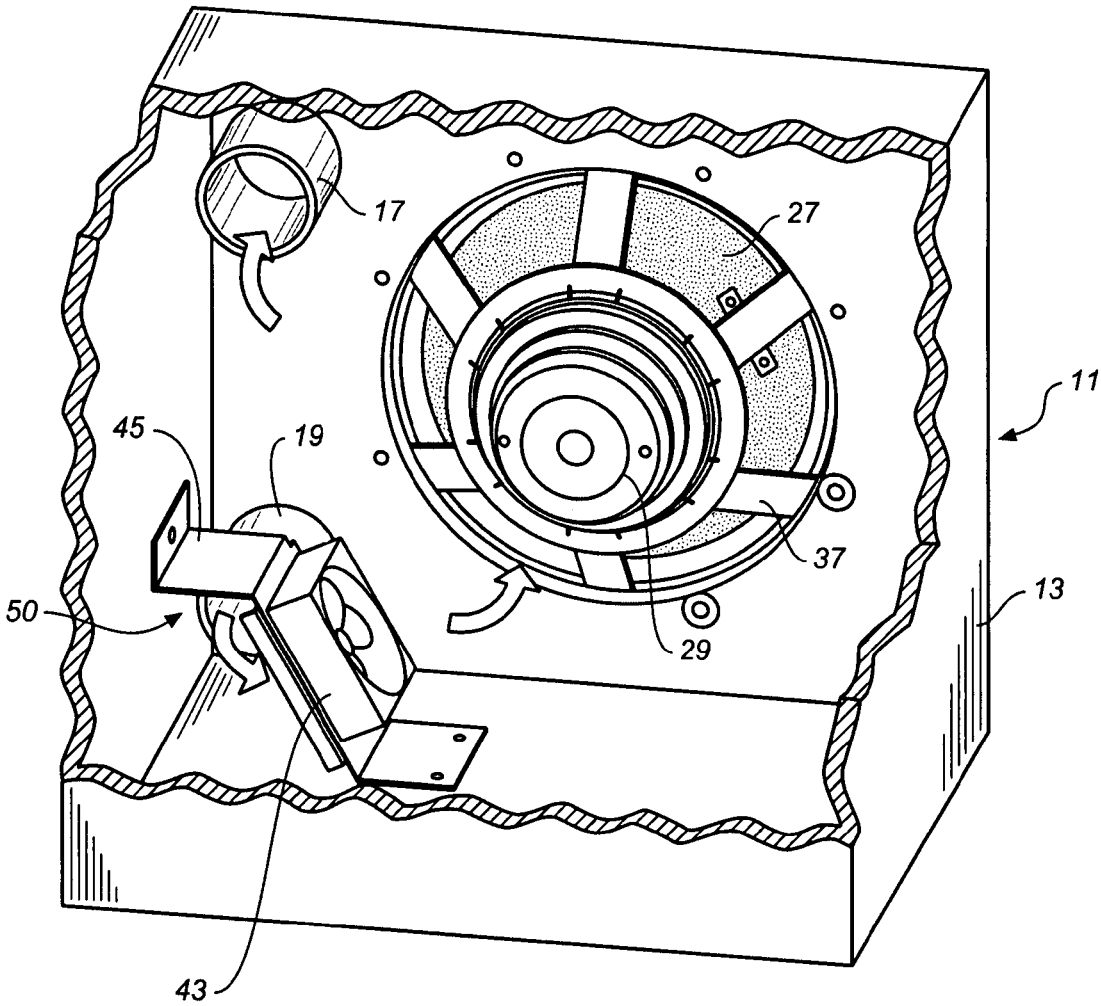
FIG. 4 is a pictorial, cross-sectional view of the loudspeaker represented in FIGS. 1-3.

The illustrated loudspeaker further includes a single transducer or "driver" 27 having a magnetic assembly 29 comprised of a base plate and center pole piece 31, a magnet 33, and a top plate 35. As best shown in FIGS. 3 and 4, the magnetic assembly is attached to the back of a basket 37 for the transducer's diaphragm 41. The outer rim 39 of diaphragm 41 is attached to the basket's front rim 42. A flange is provided at this front rim of the basket for mounting the transducer to the enclosure's front wall 15. As best seen in FIG. 3, when the transducer is mounted to the enclosure front wall as shown, the magnetic assembly 29 of the transducer, which radiates heat generated by the voice coil (not shown), projects into the enclosure.

Figure 2:
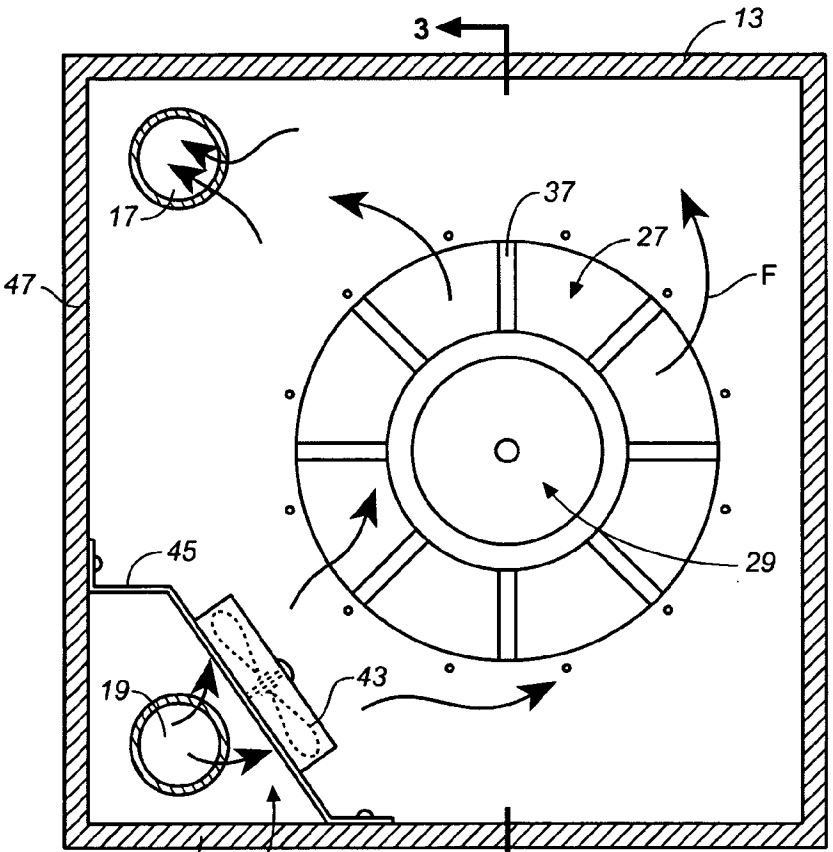
FIG. 2 is a cross-sectional view thereof, taken along lines 2-2 of FIG. 4, showing the improved cooling system of the invention.

In high power applications, a substantial amount of heat is generated by the transducer's moving voice coil (not shown). Most of this generated heat flows into the transducer's magnetic assembly, causing the magnetic assembly to heat up. Cooling of the magnetic assembly 29 is provided by producing air circulation within the vented enclosure, preferably by means of a fan 43 suitably mounted in the enclosure to a corner mounting bracket 45 secured to adjacent enclosure side walls 47, 49. The adjacent side walls 47, 49 to which the mounting bracket 45 is secured extend rearward from the enclosure's front mounting wall 15 to form a corner region 50 of the enclosure. The preferred positioning of the fan in this corner region is seen to place the fan in proximity to the lower tuning port 19, and more specifically generally behind tuning port cylinder 23, for drawing air in through this tuning port. As seen in FIGS. 2 and 3, the airflow generated by this placement of the fan causes an exchange of air in the loudspeaker enclosure—air drawn in through the lower tuning port is forced out through the upper tuning port 17. Preferably, the mounting bracket 45 positions the fan at an angle such that outside air drawn through tuning port 19 is circulated directly around the transducer's magnetic assembly 29, as indicated by airflow arrows F. By blowing air drawn from the outside directly past the magnetic assembly of transducer 27 as shown, the heat generated in the magnetic assembly can be more efficiently dissipated.

It is noted that heat generated by the transducer's voice coil is also conducted from the magnetic assembly to basket 37, which acts as an additional heat radiator. In order to improve heat dissipation through the basket 37, a thermal conductive material can be added between the magnetic assembly and the basket, thus providing a reduction in thermal resistance between these parts of the transducer, and a corresponding improvement in heat transfer to the basket. A suitable heat conductive material is a thermal compound produced by Aremco (Aremco 639) used in high power heat exchangers and other industrial applications. This compound can be applied on the contacting surfaces between the top plate 35 of the magnetic assembly and the base of basket 37.

Figure 5:
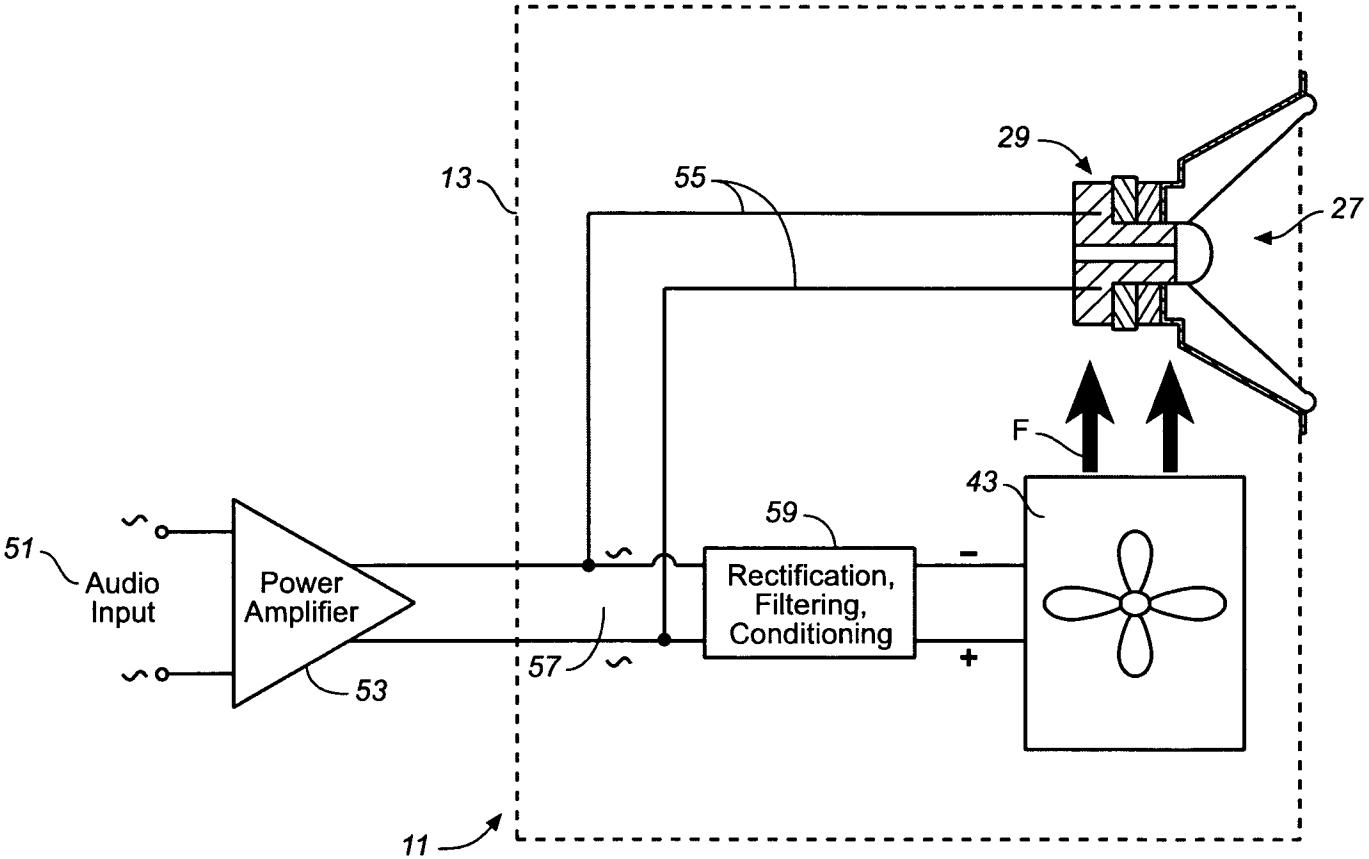
FIG. 5 is a schematic view of the wiring for the fan in the vented enclosure of the loudspeaker shown in FIGS. 1-3.

FIG. 5 shows a schematic drawing for powering the fan in the loudspeaker enclosure. Referring to FIG. 5, the loudspeaker 11 is supplied with an audio input 51 amplified by power amplifier 53 and conducted through a signal path (wiring) 55 for driving the loudspeaker transducer 27. A portion of the amplified input signal is used to run the fan 43 by tapping into the signal path at 57, and passing the tapped portion of the signal input through a suitable rectification and filtering circuit 59. A variable speed fan is preferably used, such that the fan speed will increase when the signal input power increases, and decrease when the signal input power decreases. Thus, the cooling of the fan will be proportional to the voltage supplied to the transducer. The cooling effects of the fan 43 graphically illustrated in FIG. 5 are shown by airflow arrows F in FIG. 5.

Preferably, the fan 43 will be located in the forward portion of the enclosure close to the magnetic assembly of the loudspeaker to achieve desired air flow by the magnetic assembly. However, the invention is not limited to the fan position shown, or to the use of a single fan. Also, while the cooling system of the present invention is shown as being used with a loudspeaker having a single transducer, it will be understood that the cooling system could be used in vented enclosures for loudspeakers having more than one transducer.

While the present invention has been described in considerable detail in the foregoing specification, it shall be understood that it is not intended that the invention be limited to such detail, except as necessitated by the following claims.

What I claim is:

1. A loudspeaker comprising a vented enclosure having a front mounting wall and at least two tuning ports in said front mounting wall, said vented enclosure forming a non-partitioned interior volume and said tuning ports being displaced one from the other on said mounting wall, at least one transducer mounted to the front mounting wall of said vented enclosure, said transducer having a heat radiating portion which projects into the interior volume of said enclosure, a variable speed airflow producing means positioned in said enclosure behind but not in line with one of said tuning ports such that outside air is drawn into the vented enclosure through said tuning port by said variable speed airflow producing means and such that the outside air drawn into the vented enclosure is directed toward the heat radiating portion of said transducer, said variable speed airflow producing means being actuated by a tapped portion of an amplified audio signal driving said transducer such that the speed of the airflow producing means varies with the level of the audio signal, and wherein said variable speed airflow producing means includes at least one fan positioned in said enclosure proximate but not in line with one of said tuning ports for directing airflow toward the heat radiating portion of said transducer.

2. A loudspeaker comprising a vented enclosure having a front mounting wall and enclosure side walls forming a non-partitioned interior volume and corner regions of said vented enclosure, at least two tuning ports in said front mounting wall of said vented enclosure proximate two of the corners thereof, at least one transducer mounted to the front mounting wall of said vented enclosure, said transducer having a magnetic assembly and a diaphragm basket which project into the interior volume of said enclosure, and a variable speed fan mounted in said vented enclosure in one of the corner regions thereof so as to be positioned behind and in close proximity to but not in line with one of said tuning ports and so as to displaced from the other of said tuning ports, said variable speed fan further being positioned to direct airflow produced thereby towards the magnetic assembly and diaphragm basket of said transducer, said variable speed fan being actuated by a tapped portion of an amplified audio signal driving said transducer such that the speed of the fan varies with the level of the audio signal.

3. The loudspeaker of claim 2 wherein at least one of the tuning ports of said vented enclosure is comprised of a tuning port cylinder that projects into the vented enclosure, and wherein said fan is positioned behind the tuning port cylinder of said one tuning port so as to draw outside air into the vented enclosure through said tuning port cylinder.

4. The loudspeaker of claim 2 wherein a thermally conductive material is provided between said diaphragm basket and said magnetic assembly to enhance heat transfer from the magnetic basket to the diaphragm basket whereby more heat can be radiated by the diaphragm basket.

5. The loudspeaker of claim 2 wherein said amplified audio signal varies in voltage with varying audio signal levels and wherein the speed of the fan varies with the voltage of the audio signal driving the transducer, and wherein a rectification, filtering and conditioning circuit is interposed between the amplified audio input signal and said variable speed fan.

* * * * *

UNITED STATES PATENT AND TRADEMARK OFFICE

CERTIFICATE OF CORRECTION

Figure 1:
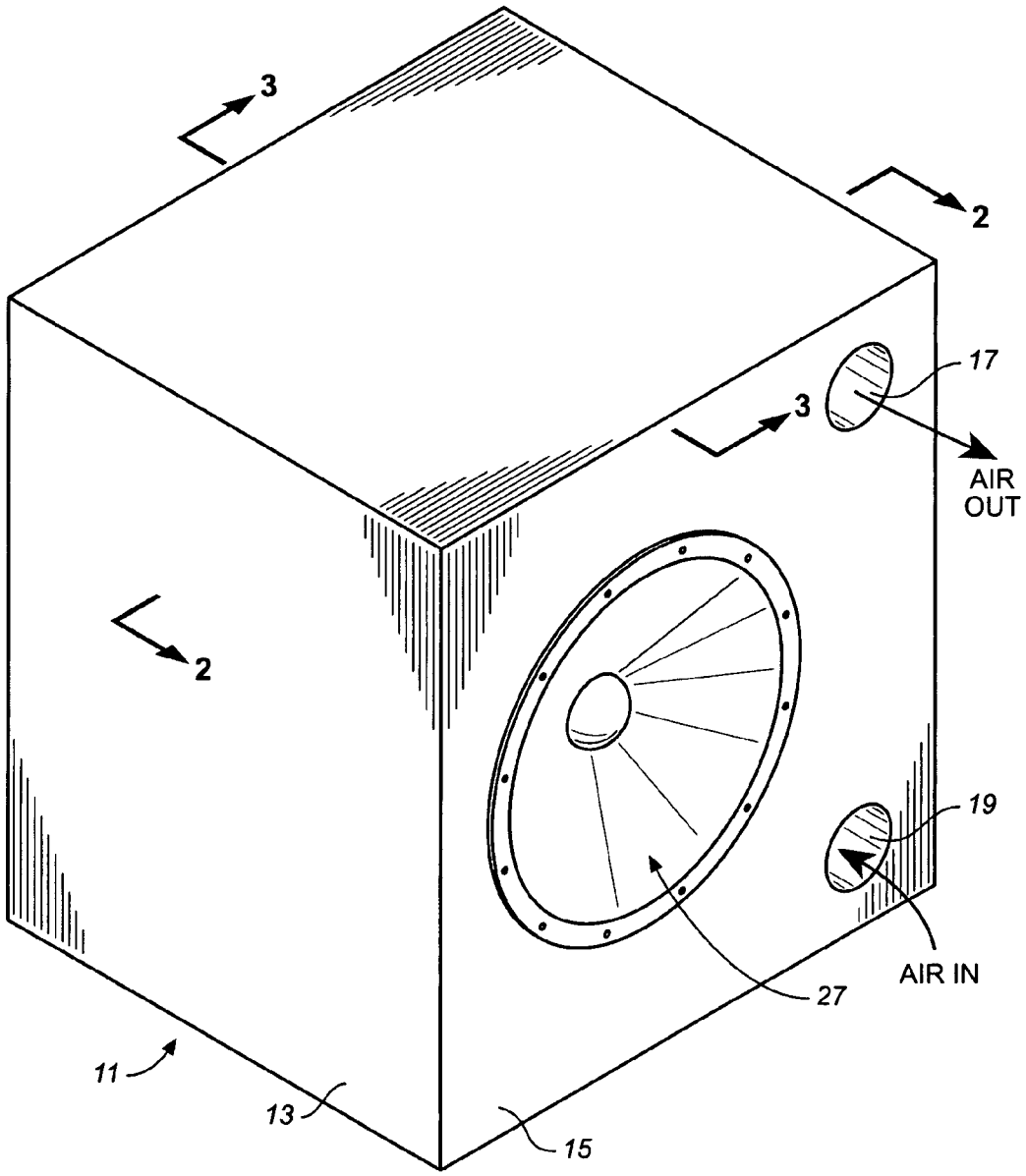
FIG. 1 is a top perspective view of a loudspeaker having a vented enclosure.

PATENT NO. : 8,699,737 B2
APPLICATION NO. : 11/800094
DATED : April 15, 2014
INVENTOR(S) : Jean-Pierre Mamin It is certified that error appears in the above-identified patent and that said Letters Patent is hereby corrected as shown below:

In the Specification
In column 2, line 26, "Fig. 4" should read --Fig. 1--.

In the Claims
In column 4, line 37, "to displaced" should read --to be displaced--.

Signed and Sealed this
First Day of December, 2015

Michelle K. Lee

Michelle K. Lee
*Director of the United States Patent and Trademark Office*